US006107752A

United States Patent [19]

Palmer et al.

[11] Patent Number: 6,107,752

[45] Date of Patent: Aug. 22, 2000

[54] COAXIAL APPLICATORS FOR ELECTRODELESS HIGH INTENSITY DISCHARGE LAMPS

[75] Inventors: Fred L. Palmer, Danvers; Walter P. Lapatovich, Boxford, both of Mass.

[73] Assignee: Osram Sylvania Inc., Danvers, Mass.

[21] Appl. No.: 09/233,867

[22] Filed: Jan. 19, 1999

Related U.S. Application Data

[60] Provisional application No. 60/076,631, Mar. 3, 1998.

[51] Int. Cl.[7] ..... H05B 41/16

[52] U.S. Cl. ..... 315/246; 315/39; 315/71; 315/248

[58] Field of Search ..... 315/246, 248, 315/39, 71; 313/113, 567, 563, 564, 565, 639

[56] References Cited

U.S. PATENT DOCUMENTS

| | | | |
|---|---|---|---|
| 3,942,058 | 3/1976 | Haugsjaa et al. | 313/44 |
| 3,942,068 | 3/1976 | Haugsjaa et al. | 313/39 |
| 3,943,403 | 3/1976 | Haugsjaa et al. | 315/39 |
| 3,995,195 | 11/1976 | Haugsjaa et al. | 315/58 |
| 4,001,632 | 1/1977 | Haugsjaa et al. | 315/39 |
| 4,185,228 | 1/1980 | Regan | 315/248 |
| 4,189,661 | 2/1980 | Haugsjaa et al. | 315/39 |
| 4,223,250 | 9/1980 | Kramer et al. | 315/248 |
| 4,247,800 | 1/1981 | Proud et al. | 315/39 |
| 4,266,162 | 5/1981 | McNeill et al. | 315/39 |
| 4,749,915 | 6/1988 | Lynch et al. | 315/248 |
| 4,887,192 | 12/1989 | Simpson et al. | 362/265 |
| 4,954,755 | 9/1990 | Lynch et al. | 315/248 |
| 5,070,277 | 12/1991 | Lapatovich et al. | 315/248 |
| 5,113,121 | 5/1992 | Lapatovich et al. | 315/39 |
| 5,130,612 | 7/1992 | Lapatovich et al. | 315/248 |
| 5,144,206 | 9/1992 | Butler et al. | 315/248 |
| 5,241,246 | 8/1993 | Lapatovich et al. | 315/248 |
| 5,280,217 | 1/1994 | Lapatovich et al. | 315/248 |
| 5,299,100 | 3/1994 | Bellows et al. | 362/263 |
| 5,448,135 | 9/1995 | Simpson | 315/39 |
| 5,498,928 | 3/1996 | Lapatovich et al. | 315/39 |
| 5,545,953 | 8/1996 | Lapatovich et al. | 315/39 |
| 5,990,627 | 11/1999 | Chen et al. | 315/248 |

*Primary Examiner*—Don Wong
*Assistant Examiner*—Thuy Vinh Tran
*Attorney, Agent, or Firm*—Carlo S. Bessone

[57] ABSTRACT

An electrodeless lamp assembly includes an electrodeless, high intensity discharge lamp capsule and a coaxial electric field applicator. The coaxial electric field applicator includes an outer conductor assembly including a tubular outer conductor having a distal end disposed at or near a first end of the lamp capsule, an outer ring disposed at or near a second end of the lamp capsule, and a plurality of cage wires connected between the outer ring and the tubular outer conductor. A center conductor assembly includes a center conductor coaxially positioned with respect to the tubular outer conductor and has a distal end disposed at or near the first end of the lamp capsule. High frequency power, supplied to the tubular outer conductor and the center conductor, is coupled by the electric field applicator to the lamp capsule. The center conductor assembly may include a guard ring positioned near the first end of the lamp capsule for concentrating electric fields in the lamp capsule.

40 Claims, 7 Drawing Sheets

COAXIAL APPLICATORS FOR ELECTRODELESS HIGH INTENSITY DISCHARGE LAMPS

CROSS REFERENCE TO RELATED APPLICATION

This application claims the benefit of provisional application Ser. No. 60/076,631 filed Mar. 3, 1998.

FIELD OF THE INVENTION

This invention relates to electrodeless high intensity discharge lamps and, more particularly, to coaxial electric field applicators used to deliver high frequency power to electrodeless high intensity discharge lamps.

BACKGROUND OF THE INVENTION

Electrodeless high intensity discharge (EHID) lamps have been described extensively in the prior art. In general, EHID lamps include an electrodeless lamp capsule containing a volatilizable fill material and a starting gas. The lamp capsule is mounted in a fixture which is designed for coupling high frequency power to the lamp capsule. The high frequency produces a light-emitting plasma discharge within the lamp capsule. Recent advances in the application of high frequency power to lamp capsules operating in the tens of watts range are disclosed in U.S. Pat. No. 5,070,277 issued Dec. 3, 1991 to Lapatovich; U.S. Pat. No. 5,113,121 issued May 12, 1992 to Lapatovich et al; U.S. Pat. No. 5,130,612 issued Jul. 14, 1992 to Lapatovich et al; U.S. Pat. No. 5,144,206 issued Sep. 1, 1992 to Butler et al; and U.S. Pat. No. 5,241,246 issued Aug. 31, 1993 to Lapatovich et al. As a result, compact EHID lamps and associated applicators have become practical.

The above patents disclose small, cylindrical lamp capsules wherein high frequency energy is coupled to opposite ends of the lamp capsule with a 180° phase shift. The applied electric field is generally colinear with the axis of the lamp capsule and produces a substantially linear discharge within the lamp capsule. The fixture for coupling high frequency energy to the lamp capsule typically includes a planar transmission line, such as a microstrip transmission line, with electric field applicators, such as helices, cups or loops, positioned at opposite ends of the lamp capsule. The microstrip transmission line couples high frequency power to the electric field applicators with a 180° phase shift. The lamp capsule is typically positioned in a gap in the substrate of the microstrip transmission line and is spaced above the plane of the substrate by a few millimeters, so the axis of the lamp capsule is colinear with the axes of the field applicators.

A well-optimized applicator should exhibit several characteristics. It should transfer power from the power source to the lamp with the highest possible efficiency. In particular, resistive heating in the applicator, microwave radiation which produces electromagnetic interference, and power reflected back toward the power source must be minimized. The applicator should be small and light; it should not block light from the lamp; and its operation should not be substantially perturbed by the proximity of metal or dielectric structures.

Anticipated applications of EHID lamps require mounting the lamp in a focusing reflector or similar optical system. In the past, this has usually required cutting a slot in the reflector in order to accommodate the circuit board of the planar applicator. The slot is often difficult and expensive to make. The slot wastes light and may create a dark spot in the outgoing beam pattern. In many cases, the optical design cannot be changed, or changes such as a slot would weaken the optical assembly or make it susceptible to environmental exposure.

Several types of power applicators for energizing EHID lamps are known in the prior art. For large EHID lamps ranging in size from a few millimeters in diameter to 25 or 30 millimeters in diameter, coupling of power using a cylindrical cavity is taught by MacLennan et al in paper P-73, SID 93 Digest, pages 716–719, 1993 and by Lynch et al in U.S. Pat. No. 4,954,755 issued Sep. 4, 1990. Spherical lamps are rotated about the stem supporting the lamp. For small cylindrical lamps, close coupling planar applicators made from printed circuit substrate material are disclosed by Lapatovich et al in U.S. Pat. No. 5,280,217 issued Jan. 18, 1994. For small spherical lamps of about 2–10 millimeters in diameter, a planar applicator fabricated from printed circuit board material using a rotating electric field is disclosed by Lapatovich et al in U.S. Pat. No. 5,498,928 issued Mar. 12, 1996. A hybrid applicator cavity/optical element is disclosed by Simpson et al in U.S. Pat. No. 4,887,192 issued Dec. 12, 1989. Electrodeless light sources, wherein an electrodeless lamp is mounted in a reflector, are disclosed in U.S. Pat. No. 4,749,915 issued Jun. 7, 1988 to Lynch et al; U.S. Pat. No. 5,299,100 issued Mar. 29, 1994 to Bellows et al; and U.S. Pat. No. 5,448,135 issued Sep. 5, 1995 to Simpson.

The cavity approach results in a large cylindrical mesh shell which does not mate well with small optical collectors, such as an automobile headlamp. The planar applicators do mate with the optical system, but their circuit boards block considerable light, and the reflectors must be slotted as described above. The rotating field applicator requires that the collector be formed in two sections and aligned around the lamp and applicator.

A variety of large coaxial termination fixtures with mesh covers were developed for high wattage electrodeless lamps for the motion picture industry as disclosed by Haugsjaa et al in U.S. Pat. No. 3,942,058 issued Mar. 2, 1976, U.S. Pat. No. 3,942,068 issued Mar. 2, 1976, U.S. Pat. No. 3,943,403 issued Mar. 9, 1976, U.S. Pat. No. 3,995,195 issued Nov. 30, 1976 and U.S. Pat. No. 4,001,632 issued Jan. 4, 1977. Coaxial termination fixtures for electrodeless lamps are also disclosed in U.S. Pat. No. 4,185,228 issued Jan. 22, 1980 to Regan; U.S. Pat. No. 4,189,661 issued Feb. 19, 1980 to Haugsjaa et al; U.S. Pat. No. 4,223,250 issued Sep. 16, 1980 to Kramer et al; U.S. Pat. No. 4,247,800 issued Jan. 27, 1981 to Proud et al; and U.S. Pat. No. 4,266,162 issued May 5, 1981 to McNeill et al. None of these fixtures are well optimized in terms of manufacturability or efficient operation of small lamps. The meshes are not shaped so as to guide the electric fields through the lamp, and they must be attached to the body of the applicator with a large number of mechanically and electrically sound connections. The variable impedance transmission lines used to match impedances are excessively long and lossy.

The aforementioned U.S. Pat. No. 3,942,058 describes the concept of field shaping, but shows devices which are unlikely to work well except for spherical or very short lamps. The outer conductor is not contoured for field shaping.

Thus, there exists a need for power applicators for EHID lamps which fit through the small hole in the rear of a typical reflector, and which can be integrated into existing optical systems effectively and inexpensively.

SUMMARY OF THE INVENTION

According to a first aspect of the invention, an electrodeless lamp assembly is provided. The electrodeless lamp assembly comprises an electrodeless high intensity discharge lamp capsule and a coaxial electric field applicator. The lamp capsule comprises a light-transmissive discharge envelope enclosing a discharge volume containing a mixture of starting gas and chemical dopant material excitable by high frequency power to a state of luminous emission. The coaxial electric field applicator comprises an outer conductor assembly including a tubular outer conductor having a distal end disposed at or near a first end of the lamp capsule, an outer ring disposed at or near a second end of the lamp capsule, and a plurality of cage wires connected between the outer ring and the tubular outer conductor. The coaxial field applicator further comprises a center conductor assembly including a center conductor coaxially positioned with respect to the tubular outer conductor and having a distal end disposed at or near the first end of the lamp capsule. High frequency power, supplied to the tubular outer conductor and the center conductor, is coupled by the electric field applicator to the lamp capsule.

Preferably, the center conductor has a hollow tubular configuration. The discharge envelope of the lamp capsule may include a lamp stem that is positioned in the interior of the hollow tubular center conductor.

The cage wires may form a reentrant cage structure between the outer ring and the tubular outer conductor. The cage structure may comprise about six to twelve cage wires, each coupled in a loop configuration between the outer ring and the distal end of the tubular outer conductor.

The outer conductor assembly may further comprise one or more elements for tuning a frequency characteristic of the coaxial electric field applicator. The tuning element may comprise a conductive tab extending from the distal end of the tubular outer conductor.

The electrodeless lamp assembly may further comprise a high frequency connector having a center conductor electrically coupled to the center conductor of the electric field applicator and an outer conductor electrically coupled to the tubular outer conductor of the electric field applicator. The center conductor assembly may further comprise a feed wire connected between the center conductor of the high frequency connector and the center conductor of the electric field applicator.

The electric field applicator may further comprise an impedance matching element coupled between a selected point on the center conductor and the tubular outer conductor of the electric field applicator. The impedance matching element may comprise a wire or other conductive element.

The center conductor assembly may further comprise a guard ring coupled to the center conductor and positioned near the first end of the lamp capsule for concentrating electric fields generated by the electric field applicator in the lamp capsule. The guard ring may have larger diameter than the center conductor and may be mechanically supported from the center conductor by a conductive structure. One or more guard rings may be utilized.

The electrodeless lamp assembly may further comprise a reflector. The coaxial electric field applicator may extend through an opening at the rear of the reflector for connection to a high frequency source. In one embodiment, the cage wires extend between the outer ring and the tubular outer conductor inside the reflector. In another embodiment, the cage wires extend between the outer ring and the tubular outer conductor outside the reflector.

In one embodiment, the discharge envelope of the lamp capsule comprises a substantially cylindrical quartz envelope and the chemical dopant material comprises a metal halide salt and mercury. Sodium and scandium iodide or rare earth iodide salts may be utilized for producing visible light during discharge. In another embodiment, the chemical dopant material comprises phosphorous or mercury for producing ultraviolet radiation during discharge. In yet another embodiment, the chemical dopant material comprises cesium iodide for producing infrared radiation during discharge.

BRIEF DESCRIPTION OF THE DRAWINGS

For a better understanding of the present invention, reference is made to the accompanying drawings, which are incorporated herein by reference and in which.

DETAILED DESCRIPTION

Figure 1:
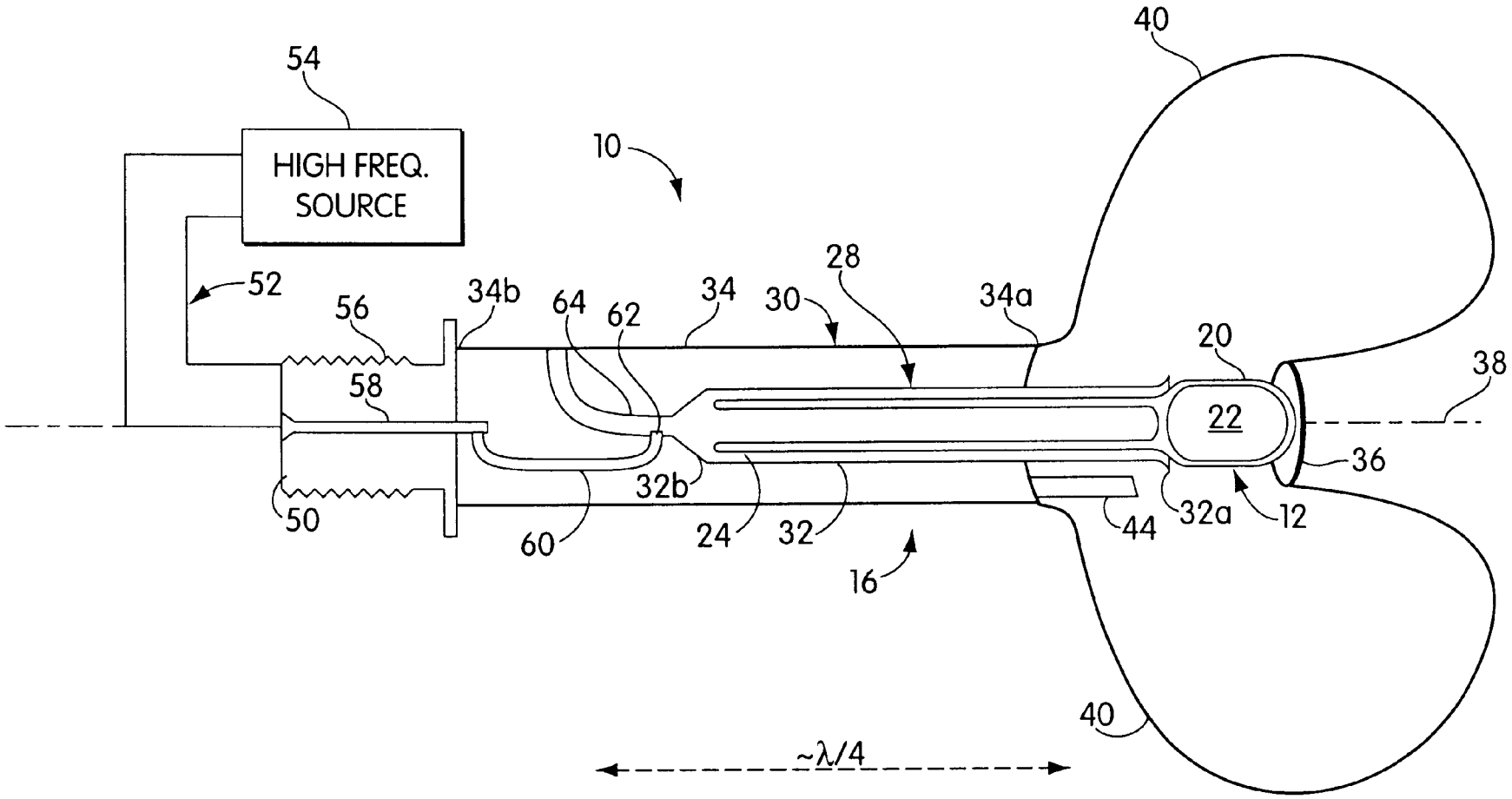
FIG. 1 is a schematic cross-sectional view of a first embodiment of an electrodeless lamp assembly in accordance with the invention.

A schematic cross-sectional view of an electrodeless lamp assembly 10 accordance with a first embodiment of the invention is shown in FIG. 1. An electrodeless high intensity lamp capsule 12 is mounted in a coaxial electric field applicator 16. Lamp capsule 12 includes an electrodeless light-transmissive discharge envelope 20 enclosing a discharge volume 22 containing a mixture of starting gas and chemical dopant material excitable by high frequency power to a state of luminous emission. Discharge envelope 20 includes a lamp stem 24.

Electric field applicator 16 includes an outer conductor assembly 30 and a center conductor assembly 28 coaxially positioned with respect to outer conductor assembly 30. Outer conductor assembly 30 includes a tubular outer conductor 34 having a distal end 34*a* disposed at or near a first end of discharge volume 22 of lamp capsule 12, an outer ring 36 disposed at or near a second end of discharge volume 22 of lamp capsule 12, and a plurality of cage wires 40 which form a cage structure.

Cage wires 40 are connected between outer ring 36 and the distal end 34*a* of tubular outer conductor 34. Cage wires 40 provide an electrical return path between outer ring 36 and tubular outer conductor 34. The number, diameter and spacing of cage wires 40 are selected as a tradeoff between limiting radiation of high frequency energy and limiting light blockage. Suitable configurations may utilize approximately six to twelve cage wires, but are not limited to this range. Specific examples are described below.

The cage structure formed by cage wires 40 preferably has a diameter that is substantially larger than the diameter of lamp capsule 12. Preferably, the cage structure has a maximum diameter in a range of about 2 to 12 times the diameter of discharge envelope 20. By way of example, cage wires 40 may be 0.020 inch diameter wire. Cage wires 40 may curve outwardly away from outer conductor 34 and form loops which extend axially beyond outer ring 36. Cage wires 40 may be nearly parallel to an applicator axis 38 where they are connected to outer ring 36, thereby forming a reentrant cage structure. It will be understood that different cage structures may be utilized within the scope of the present invention. The cage structure is designed to provide a conductive return path between outer ring 36 and tubular outer conductor 34, while limiting radiation of high frequency energy and limiting light blockage.

Outer conductor assembly 30 may further include one or more conductive tabs, such as tab 44, which extend from the distal end 34*a* of tubular outer conductor 34. Tab 44 may be adjusted in length and position relative to lamp capsule 12 to maximize transfer of high frequency power to lamp capsule 12 and to minimize reflected high frequency power.

Center conductor assembly 28 may comprise a hollow tubular center conductor 32 that is coaxially positioned with respect to tubular outer conductor 34 on applicator axis 38. A distal end 32*a* of center conductor 32 is positioned at or near the first end of discharge volume 22 of lamp capsule 12 and may be flared outwardly for shaping of electric fields in discharge volume 22. Lamp stem 24 of discharge envelope 20 is positioned within hollow center conductor 32 and is secured in position with a high temperature cement, such as Cotronics No. 809, for example. Typically, the distal end 32*a* of center conductor 32 extends beyond the distal end 34*a* of tubular outer conductor 34, so that the distal end 34*a* of tubular outer conductor 34 is spaced from lamp capsule 12, as shown in FIG. 1.

Center conductor 32 and outer conductor 34 may be connected through a high frequency connector 50 and a coaxial cable 52 to a high frequency source 54. In particular, a proximal end 34*b* of outer conductor 34 is connected to an outer conductor 56 of connector 50. Center conductor assembly 28 may further include a feed wire 60 connected between a proximal end 32*b* of center conductor 32 and a center conductor 58 of connector 50.

An impedance matching element, which may comprise a wire 64, is connected between the proximal end 32*b* of tubular center conductor 32 and outer conductor 34. Feed wire 60 is connected to a point 62 on center conductor 32 or wire 64 that is selected to optimize transfer of high frequency power to lamp capsule 12. In an embodiment which operates at 2.45 GHz, feed wire 60 is connected at a point on wire 64 approximately 1 to 2 centimeters from ground. It will be understood that different impedance matching elements may be utilized within the scope of the invention. In a suitably designed coaxial applicator, an impedance matching element may not be required. In general, high frequency power is coupled from source 54 to center conductor 32 and outer conductor 34, so as to transfer high frequency power to lamp capsule 12 with low reflected and radiated power.

The EHID lamp assembly of the present assembly can operate at any frequency in a range of 13 MHz to 20 GHz at which substantial power can be developed. The operating frequency is typically selected in one of the ISM bands. The frequencies centered around 915 MHz and 2.45 GHz are particularly appropriate.

Coaxial electric field applicators of the type shown in FIG. 1 and described above have been tested with small EHID lamps capsules. In one example, discharge envelope 20 is 2 millimeters inner diameters by 3 millimeters outer diameter by internal length of 4 millimeters, also referred to as a 2×3×4 lamp. The discharge envelopes are filled with a volatile salt such as a Na—Sc iodide in the range of 0.02 milligram to 0.05 milligram with a preferred dose of 0.04 milligram; a mercury charge in the range of 0 to 1 milligram with a preferred dose of 0.5 milligram; and an inert gas as a starting aid in the range of 0.1 torr to 100 torr with a preferred cold fill pressure of 5 torr. The inert gas may be neon, argon, krypton, xenon, or a mixture of these gases with the preferred gas being argon. The lamp capsules have an operating pressure during discharge in the range of about 1 to 30 atmospheres.

Lamp capsules utilized in the coaxial electric field applicator of the present invention typically have a roughly cylindrical shape. However, other discharge envelope shapes, such as spheres, hemispheres, prolate and oblate ellipsoids, and constricted or narrow bore lamps that are pinched in the middle, may be utilized within the scope of the present invention. A quartz discharge envelope may be used when the lamp capsule is designed to produce visible light. The chemical dopant material is selected to produce visible light, infrared radiation or ultraviolet radiation in response to excitation by high frequency power. Metal halide salts, such as sodium and scandium iodide or rare earth iodide salts, and mercury may be used to produce visible light during discharge. Phosphorous or mercury may be used to produce ultraviolet radiation during discharge. Cesium iodide may be used to produce infrared radiation during discharge. Other chemical dopant materials for producing radiation having a desired spectrum are known to those skilled in the art.

In one example of a coaxial electric field applicator as shown in FIG. 1 for operation with a 20 watt EHID lamp capsule, tubular outer conductor 34 had an outside diameter of 0.31 inch, an inside diameter of 0.26 inch and a length of 0.80 inch. Outer ring 36 had an inside diameter of 0.125 inch, and was fabricated of 0.030 inch diameter wire. Six cage wires were spaced by 60 degrees around lamp capsule 12. Cage wires 40 had lengths of 1.30 inch each and were made of 0.020 inch diameter wire. Center conductor 32 had an outside diameter of 0.125 inch and a wall thickness of 0.010 inch. The tubular portion of center conductor 32 had a length of about 0.47 inch. Connector 50 was a standard SMA conductor, and feed wire 60 had a length of about 0.42 inch and a diameter of 0.025 inch. The lamp operated a frequency of 2.45 GHz.

Figure 2:
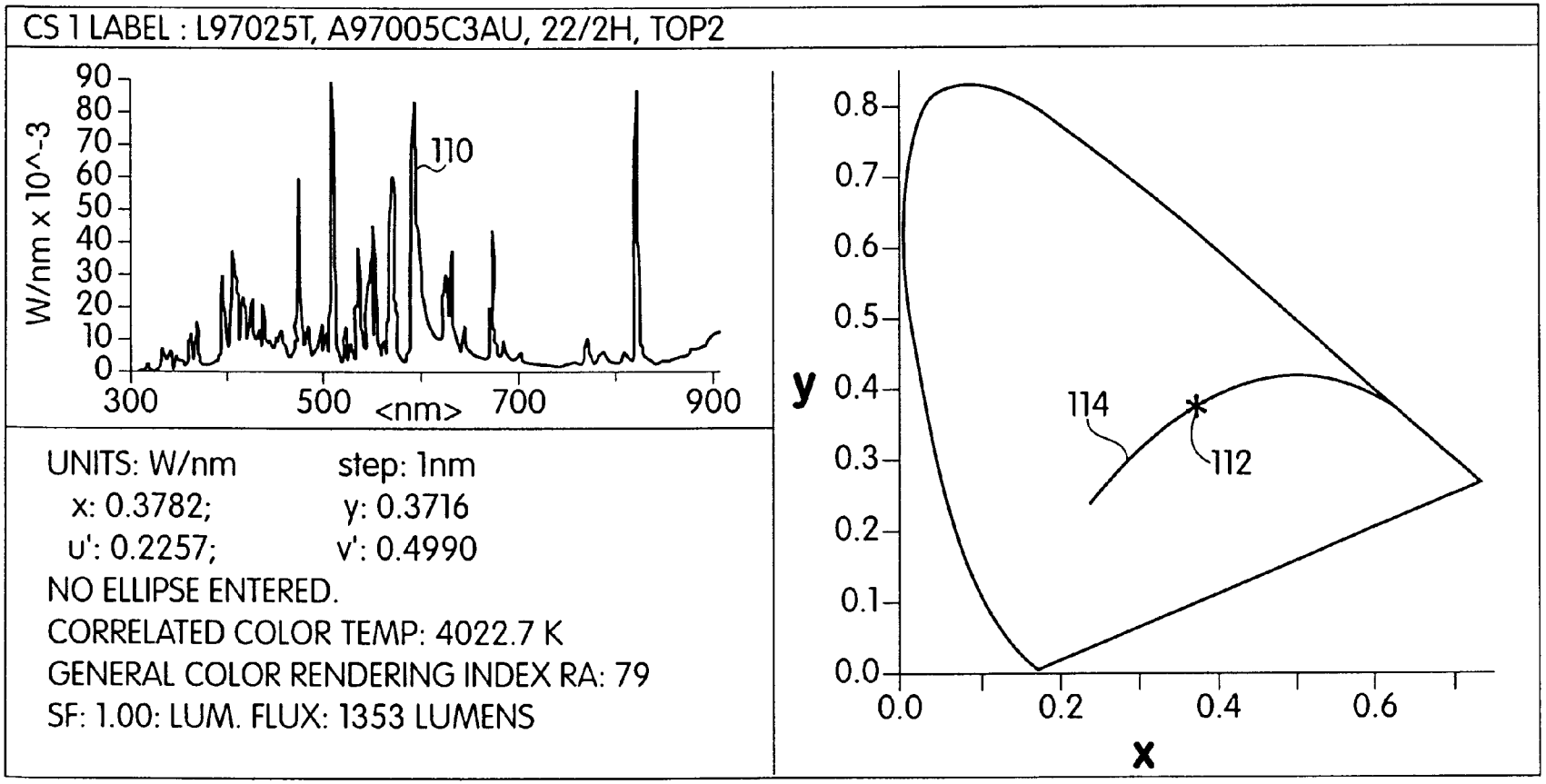
FIG. 2 shows a graph of lamp capsule output power as a function of wavelength and a chromaticity diagram, illustrating the performance of an electrodeless lamp assembly in accordance with the invention.

The performance of a representative 20 watt EHID lamp, constructed as described above, is illustrated in FIG. 2. Trace 10 illustrates the spectral distribution in milliwatts per nanometer. The lamp had a correlated color temperature of 4022.7 K, had a general color rendering index (CRI) of 79, and produced 1353 lumens output, as measured in a calibrated integrating sphere. The lamp produced x and y chromaticity coordinates 112, which are positioned on a black body locus 114, indicative of a lamp which appears to produce white light. The luminance measurements, taken with a spot spectrophotometer, were 55 Cd/mm$^2$ compared to about 15 Cd/mm$^2$ for a 50 watt halogen bulb. The lumen output, color and CRI are impressive for a small lamp.

Measurements of the voltage reflection coefficient establish the quality factor, or "Q", of the coaxial electric field applicator. The efficiency with which the applicator couples energy to the lamp capsule can be determined by comparing the quality factors measured while the lamp capsule is lit and unlit. The coupling efficiencies for the lamp assemblies of the present invention are measured in the range of 80–90%, compared to 40–70% for prior art planar applicators. Radiated high frequency power is measured to be less than 1% of input, and the applicator and lamp capsule can be placed in any orientation near a metal surface with no visible alteration of performance.

Figure 3:
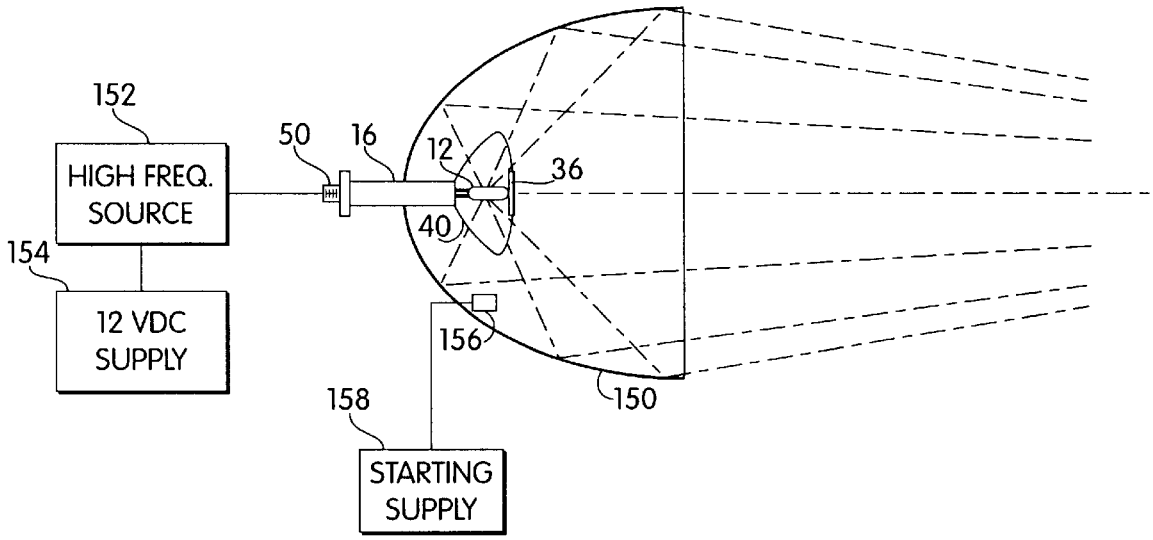
FIG. 3 is a schematic diagram of a first example of a light source wherein an electrodeless lamp assembly is mounted in a reflector.

An example of a light source wherein the electrodeless lamp assembly 10 is mounted within a reflector 150 as shown in FIG. 3. In this embodiment, the reflector 150 is large enough to accommodate the entire electric field applicator 16. Applicator 16 extends through an opening in the rear of reflector 150. The shadows cast by cage wires 40 can be minimized by reducing the diameters of the wires and/or by using a dappled or a frosted lens on the reflector 150 to homogenize the far field light beam. Such a light source can be, for example, an automobile headlamp assembly.

Connector 50 of the coaxial electric field applicator 16 may be connected to a high frequency source 152. A 12 volt DC supply 154 supplies a DC voltage to high frequency source 152. A starter for EHID lamp capsule 12, such as an ultraviolet source 156 is mounted within reflector 150 in line of sight to lamp capsule 12. Ultraviolet source 156 receives electrical energy from a low wattage starting supply 158. A variety of devices for starting discharges in electrodeless lamp capsules are known to those skilled in the art.

Figure 4:
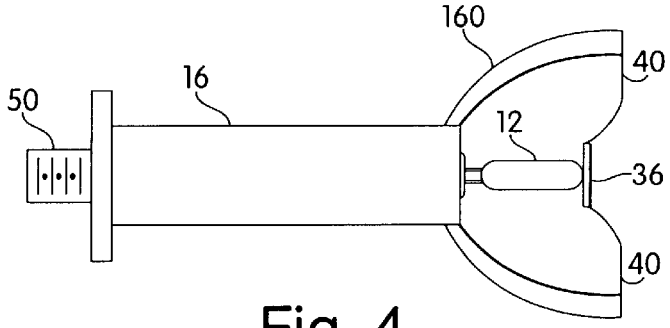
FIG. 4 is a schematic diagram of a second example of a light source wherein an electrodeless lamp assembly i s mounted in a reflector.

FIG. 4 shows an example of a light source utilizing a small reflector 160, such as used for halogen downlighting systems and commonly referred to as MR16 lamps. In this case, the reflector 160 is small enough that the cage wires 40 can be located outside the glass or plastic reflector. The cage wires may be printed on the glass or plastic substrate of the reflector and may be connected to the outer ring 36 in the vicinity of lamp capsule 12 with a spider-like structure. The advantage of this configuration is that the cage wires 40 do not cast a shadow on the active area of the reflector.

Figure 5:
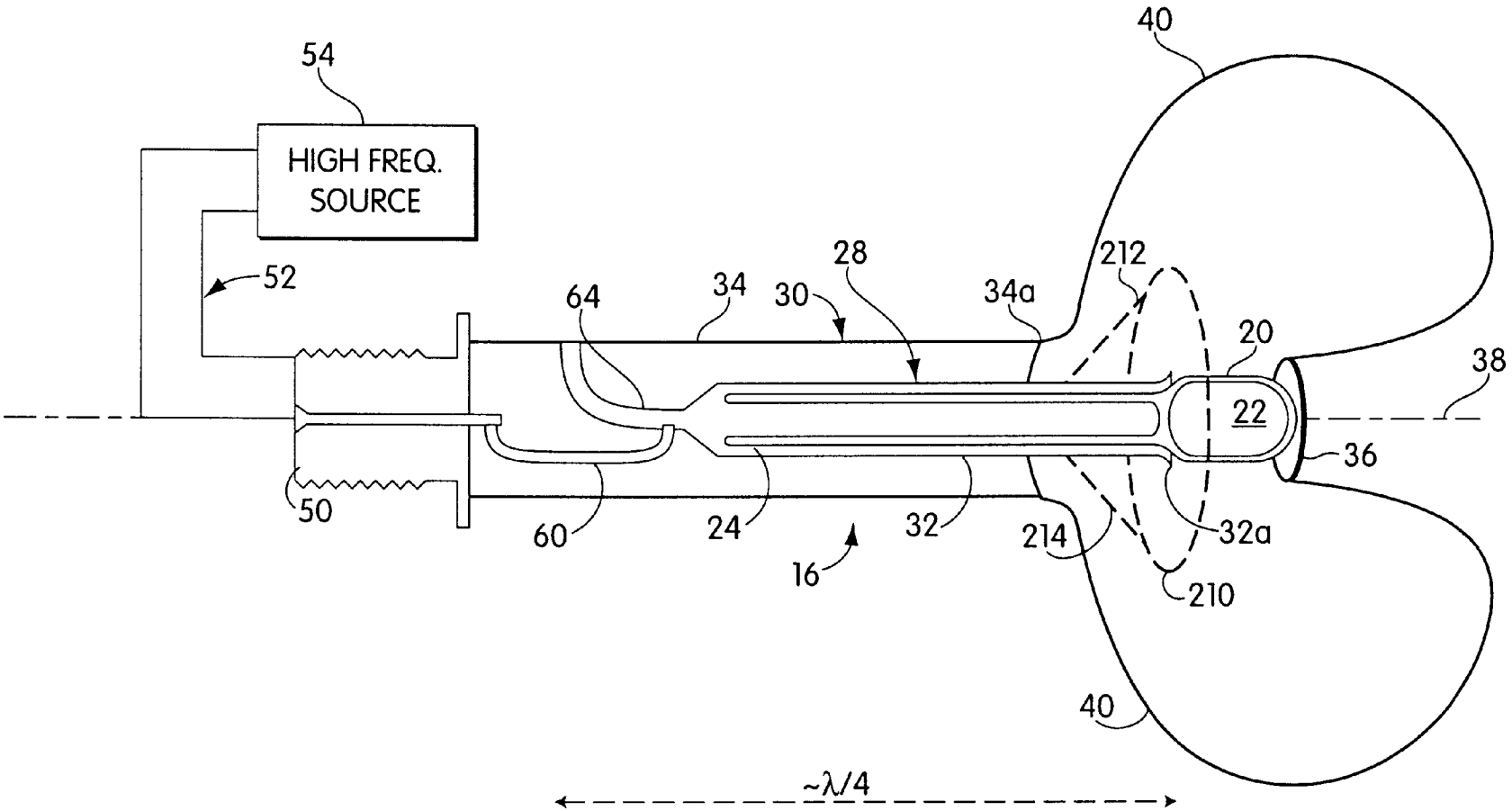
FIG. 5 is a schematic cross-sectional view of a second embodiment of an electrodeless lamp assembly in accordance with the invention.

A second embodiment of an electrodeless lamp assembly in accordance with the invention is shown in FIG. 5. Like elements in FIGS. 1 and 5 have the same reference numerals. In the embodiment of FIG. 5, center conductor assembly 28 further includes guard ring 210 positioned around the distal end 32*a* of center conductor 32. Guard ring 210 is connected to center conductor 32 by one or more supporting wires 212, 214, the preferred number being two or three wires. Guard ring 210 concentrates or guides electric fields from center conductor 32 along axis 38 of the lamp assembly, thereby energizing the lamp capsule 20 relatively uniformly, as opposed to energizing only one end. As a result, EHID lamps running at equal power will have cooler temperatures at their hottest points when guard ring 210 is utilized, resulting in longer life. The brightness of the lamp, and presumably the luminous efficacy are also improved.

In one example, guard ring 210 may be fabricated of 0.020 inch diameter wire, may have an outside diameter of 0.30 inch and may be coplanar with the distal end 32*a* of center conductor 32. This guard ring configuration, which is preferred for 20 watt lamps having an outside diameter 3 millimeters and length of 6 millimeters, provides good field shaping, and blocks very little light from the lamp. Longer lamp capsules utilize a larger guard ring and/or one placed forward of center conductor 32. Guard rings work particularly well when they are used in coaxial applicators with reentrant cage structures, since this cage structure also helps to guide the electric fields. One or more guard rings may be utilized for shaping electric fields in the vicinity of lamp capsule 20. The guard rings may have the same or different positions along axis 38. Guard rings may also be used in other coaxial electric field applicators (sometimes called termination fixtures) and in planar applicators. An additional benefit of the guard ring is that it lowers the resonance frequency of the electric field applicator, with a result that the entire structure can be several millimeters shorter. The supports for the guard ring may be attached at any convenient point along center conductor 32.

EHID lamp capsules (2 millimeters ID, 3 millimeters OD, 6 millimeters long, with Na—Sc chemistry and 0.4 milligrams of mercury) rated at 20 watts were tested in an applicator having a guard ring, and an applicator not having a guard ring. The lamp capsule operating in an applicator without a guard ring showed a 300° C. temperature difference from one end of the lamp capsule to the other. The guard ring eliminated this temperature difference and reduced the hottest temperature on the lamp by 150° C. In addition, the arc luminance of the lamp with the guard ring was 67 Cd/mm$^2$ compared to 60 Cd/mm$^2$ for the lamp not having a guard ring.

Figure 6:
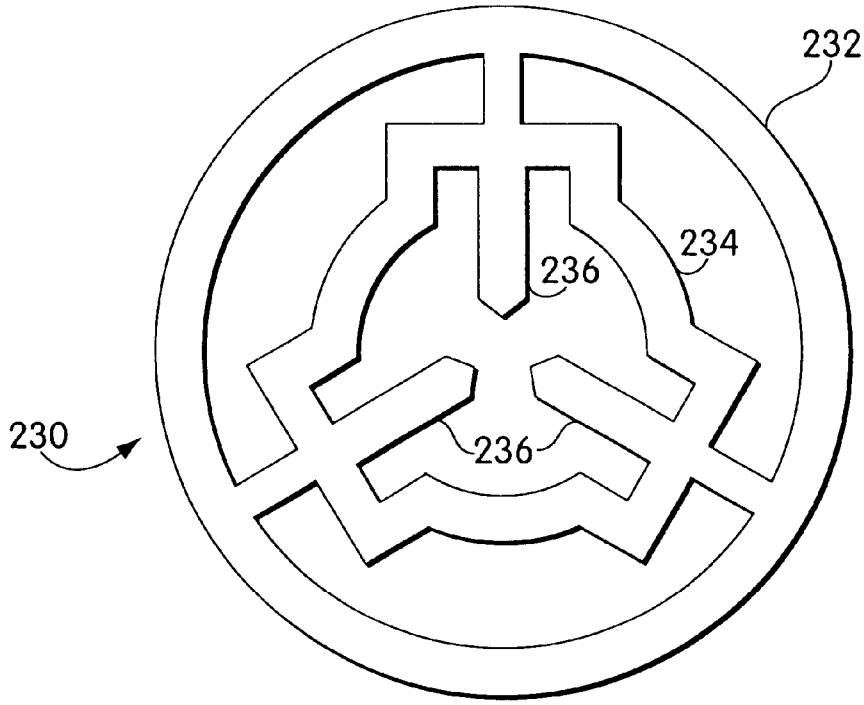
FIG. 6 illustrates an example of an implementation of the guard ring shown in FIG. 5.

An implementation of a guard ring 230 which may be fabricated by stamping or etching is shown in FIG. 6. Guard ring 230 includes an outer ring 232, an inner ring 234 and radial tabs 236. Tabs 236 are bent downwardly and are secured to the outer surface of center conductor 32.

Figure 7:
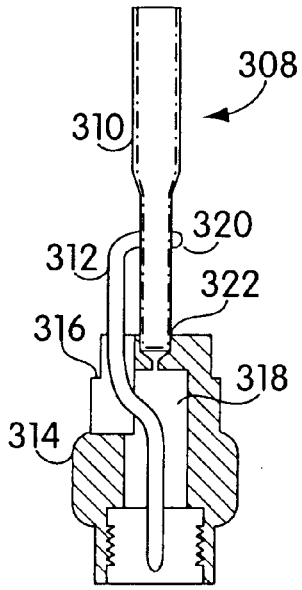
FIG. 7 is a cross-sectional view of the center conductor of an electrodeless lamp assembly in accordance with a third embodiment of the invention.
Figure 8:
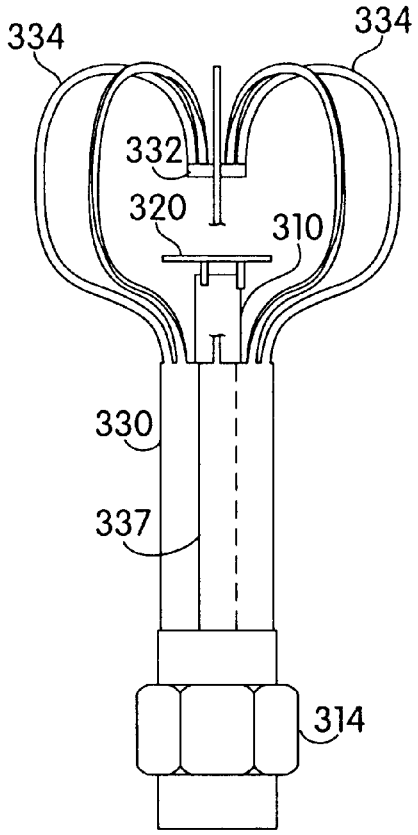
FIG. 8 is a side view of a coaxial electric field applicator in accordance with the third embodiment.
Figure 9:
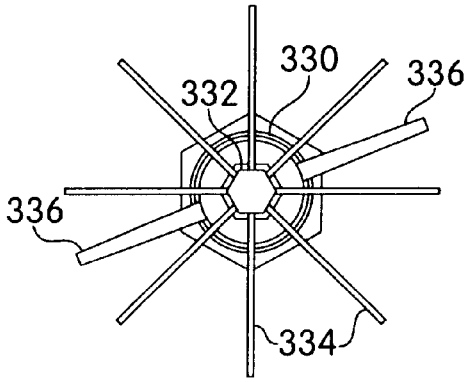
FIG. 9 is a top view of the coaxial electric field applicator shown in FIG. 8.

A third embodiment of the coaxial electric field applicator of the present invention is shown in FIGS. 7–9. The EHID lamp capsule is omitted from FIGS. 7–9. A center conductor assembly 308 shown in FIG. 7 includes a tubular center conductor 310, a feed wire 312 and a base 314. Feed wire 312 is connected to an intermediate point 320 on center conductor 310, and base 314 is connected to a proximal end 322 of center conductor 310. Base 314 provides a connection to the outer conductor (not shown in FIG. 7) of the electric field applicator and functions as an impedance matching device. Base 314 includes an opening 316 that communicates with a central bore 318. Feed wire 312 passes through opening 316 and central bore 318 for connection to the center conductor of a high frequency connector. As shown in FIG. 8, the center conductor assembly also includes a guard ring 320 affixed to the distal end of center conductor 310.

An outer conductor assembly includes a tubular outer conductor 336, an outer ring 332 and cage wires 334 interconnecting outer ring 332 and tubular outer conductor 330. Cage wires 334 form a cage structure having eight cage wires spaced apart by 45°. The outer conductor assembly also includes tabs 336 attached to outer conductor 330 for adjusting the resonance frequency of the coaxial electric field applicator.

Figure 10:
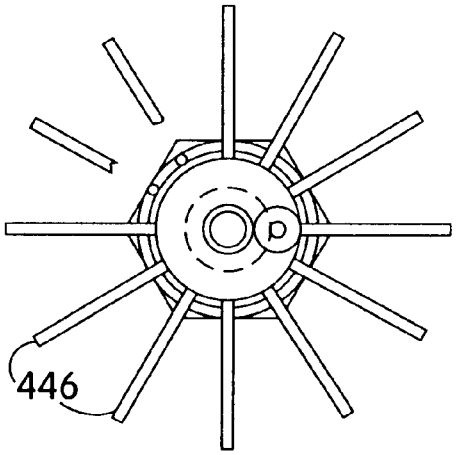
FIG. 10 is a schematic cross-sectional view of a fourth embodiment of an electrodeless lamp assembly in accordance with the invention.
Figure 11:
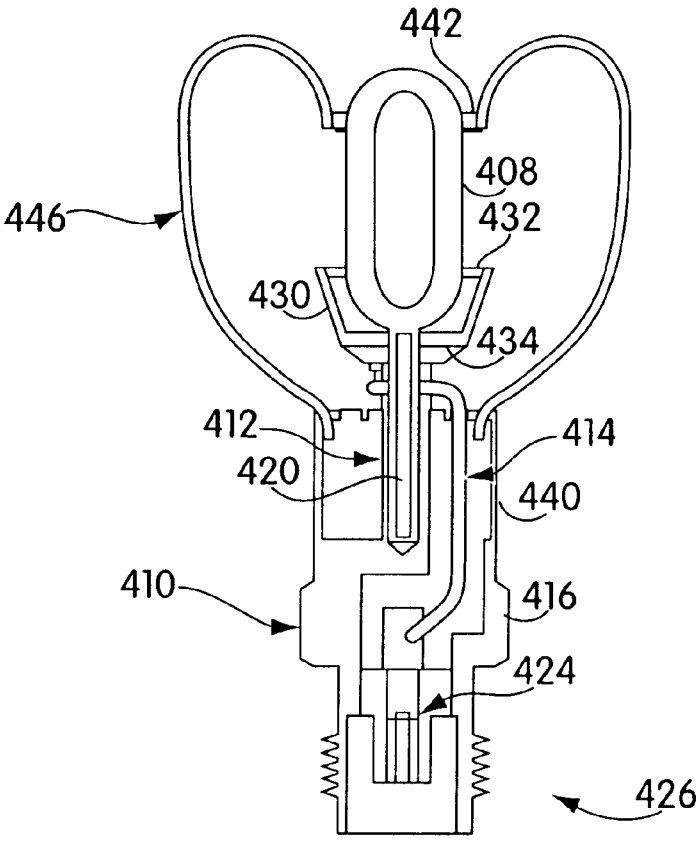
FIG. 11 is a top view of the electrodeless lamp assembly shown in FIG. 10.

A fourth embodiment of an electrodeless lamp assembly in accordance the invention is shown in FIGS. 10 and 11. The embodiment of FIGS. 10 and 11 is suitable for a higher wattage lamp capsule, but is not limited to use with a high wattage lamp capsule. The lamp assembly of FIGS. 10 and 11, which includes a lamp capsule 408 and a coaxial electric field applicator 410, may have an input power of 150 watts. Lamp capsule 408 may have an outside diameter of 8 millimeters, an inside diameter of 4 millimeters and an inside length of 15 millimeters. A center conductor assembly of the coaxial electric field applicator 410 includes a tubular center conductor 412, a feed wire 414 and a base 416. A stem 420 of lamp capsule 408 extends into tubular center conductor 412. Feed wire 414 is connected between an intermediate point of center conductor 412 and a center pin 424 of a coaxial connector 426.

The center conductor assembly further includes a guard ring structure 430, including a first guard ring 432 and a second guard ring 434. Guard ring 432 has a larger diameter than guard ring 434 and is axially spaced from guard ring 434 toward lamp capsule 408.

An outer conductor assembly includes a tubular outer conductor 440, an outer ring 442 and cage wires 446 coupled between outer ring 442 and tubular outer conductor 440. In the embodiment of FIGS. 10 and 11, twelve cage wires 446 spaced apart at 30° intervals form a cage structure. Outer ring 442 is located at the opposite end of lamp capsule 408 from center conductor 412.

For optimum performance, the metal parts of the coaxial applicator should be made from good electrical conductors capable of withstanding temperatures of a few hundred degrees centigrade. Nickel works well, especially for the parts closest to the lamp. The outer tube may be made from nickel, brass or other materials, and the electrical connector may be a standard SMA, TNC, or other panel mount connector. Metal parts can be joined by welding or brazing with silver alloys such as (AWS) BAg-7 or nickel alloy such as BNi-3. The preferred embodiment employs silver brazes. Prototype cages may be made by holding the 6 to 12 wires in a jig, brazing the outer ring into place, and bending the wires to the appropriate shape. A more manufacturable design is shown in FIG. 8 where the cage wires 334, outer ring 332, and outer conductor 330 are all etched from a single sheet of nickel which is then rolled to the appropriate shape and brazed along seam 337.

While there have been shown and described what are at present considered the preferred embodiments of the present invention, it will be obvious to those skilled in the art that various changes and modifications may be made therein without departing from the scope of the invention as defined by the appended claims.

What is claimed is:

1. An electrodeless lamp assembly comprising:

an electrodeless, high intensity discharge lamp capsule comprising a light-transmissive discharge envelope enclosing a discharge volume containing a mixture of starting gas and chemical dopant material excitable by high frequency power to a state of luminous emission; and a coaxial electric field applicator comprising:

an outer conductor assembly comprising a tubular outer conductor having a distal end disposed at or near a first end of said lamp capsule, an outer ring disposed at or near a second end of said lamp capsule, and a plurality of cage wires connected between said outer ring and said tubular outer conductor; and a center conductor assembly comprising a center conductor coaxially positioned with respect to said tubular outer conductor and having a distal end disposed at or near the first end of said lamp capsule, wherein high frequency power, supplied to said tubular outer conductor and said center conductor, is coupled by said electric field applicator to said lamp capsule.

2. An electrodeless lamp assembly as defined in claim 1 wherein said center conductor has a hollow tubular configuration.

3. An electrodeless lamp assembly as defined in claim 2 wherein the discharge envelope of said lamp capsule includes a lamp stem that is positioned in the interior of said hollow tubular center conductor.

4. An electrodeless lamp assembly as defined in claim 1 wherein said cage wires form a reentrant cage structure between said outer ring and said tubular outer conductor.

5. An electrodeless lamp assembly as defined in claim 4 wherein said cage structure comprises about six to twelve cage wires, each coupled in a loop configuration between said outer ring and the distal end of said tubular outer conductor.

6. An electrodeless lamp assembly as defined in claim 1 wherein the distal end of said tubular outer conductor is spaced from the first end of said lamp capsule.

7. An electrodeless lamp assembly as defined in claim 1 wherein said outer conductor assembly further comprises one or more conductive tabs extending from the distal end of said tubular outer conductor.

8. An electrodeless lamp assembly as defined in claim 1 wherein said outer conductor assembly further comprises a tuning element, attached to said tubular outer conductor, for adjusting a frequency characteristic of said coaxial electric field applicator.

9. An electrodeless lamp assembly as defined in claim 1 wherein said center conductor has a length of about one quarter of the wavelength of said high frequency power.

10. An electrodeless lamp assembly as defined in claim 1 wherein said high frequency power has a frequency of about 2.45 GHz.

11. An electrodeless lamp assembly as defined in claim 1 wherein said high frequency power has a frequency in a range of about 13 MHz to 20 GHz.

12. An electrodeless lamp assembly as defined in claim 1 further comprising a high frequency connector having a center conductor electrically coupled to the center conductor of said electric field applicator and an outer conductor electrically coupled to the tubular outer conductor of said electric field applicator.

13. An electrodeless lamp assembly as defined in claim 12 wherein said center conductor assembly further comprises a feed wire connected between the center conductor of said high frequency connector and the center conductor of said electric field applicator.

14. An electrodeless lamp assembly as defined in claim 1 wherein said coaxial electric field applicator further comprises an impedance matching element coupled between said center conductor and said tubular outer conductor.

15. An electrodeless lamp assembly as defined in claim 14 wherein said impedance matching element comprises a wire.

16. An electrodeless lamp assembly as defined in claim 1 further comprising a reflector, wherein said coaxial electric field applicator extends through said reflector.

17. An electrodeless lamp assembly as defined in claim 16 wherein said cage wires extend between said outer ring and said tubular outer conductor inside said reflector.

18. An electrodeless lamp assembly as defined in claim 16 wherein said cage wires extend between said outer ring and said tubular outer conductor outside said reflector.

19. An electrodeless lamp assembly as defined in claim 1 wherein said discharge envelope comprises a substantially cylindrical quartz envelope and wherein said chemical dopant material comprises a metal halide salt and mercury.

20. An electrodeless lamp assembly as defined in claim 1 wherein said plurality of cage wires comprises six wires spaced apart at approximately 60° intervals around said lamp capsule.

21. An electrodeless lamp assembly as defined in claim 1 wherein said plurality of cage wires comprises eight cage wires spaced apart at approximately 45° intervals around said lamp capsule.

22. An electrodeless lamp assembly as defined in claim 1 wherein said chemical dopant material comprises sodium and scandium iodide salts and mercury and said starting gas comprises argon, wherein said lamp capsule produces visible light during discharge.

23. An electrodeless lamp assembly as defined in claim 1 wherein said chemical dopant material comprises phosphorous or mercury for producing ultraviolet radiation during discharge.

24. An electrodeless lamp assembly as defined in claim 1 wherein said chemical dopant material comprises cesium iodide for producing infrared radiation during discharge.

25. A coaxial electric field applicator for coupling high frequency power to an electrodeless high intensity discharge lamp capsule, comprising:

an outer conductor assembly comprising a tubular outer conductor having a distal end for positioning at or near a first end of a lamp capsule, an outer ring for positioning at or near a second end of the lamp capsule, and a plurality of cage wires connected between said outer ring and said tubular outer conductor; and a center conductor assembly comprising a center conductor coaxially positioned with respect to tubular outer conductor and having a distal end for positioning at or near the first end of the lamp capsule, wherein high frequency power, supplied to the tubular outer conductor and the center conductor, is coupled by the electric field applicator to the lamp capsule.

26. A coaxial electric field applicator as defined in claim 25 wherein said center conductor has a hollow tubular configuration.

27. A coaxial electric field applicator as defined in claim 25 wherein said cage wires form a reentrant cage structure between said outer ring and said tubular outer conductor.

28. A coaxial electric field applicator as defined in claim 25 wherein said outer conductor assembly further comprises one or more conductive tabs extending from the distal end of said tubular outer conductor.

29. A coaxial electric field applicator as defined in claim 25 wherein said outer conductor assembly further comprises a frequency tuning element coupled to said tubular outer conductor.

30. A coaxial electric field applicator as defined in claim 25 wherein said center conductor assembly further comprises a feed wire for connecting the center conductor of said electric field applicator to a high frequency connector.

31. A coaxial electric field applicator as defined in claim 25 further comprising an impedance matching element coupled between said center conductor and said tubular outer conductor.

32. A coaxial electric field applicator as defined in claim 25 wherein said center conductor assembly further comprises a guard ring coupled to said center conductor and positioned near the distal end of said center conductor for concentrating electric fields generated by the electric field applicator in the lamp capsule.

33. An electrodeless light source comprising:

a reflector;

a high frequency power source;

an electrodeless high intensity discharge lamp capsule comprising a light-transmissive discharge envelope enclosing a discharge volume containing a mixture of starting gas and chemical dopant material excitable by high frequency power to a state luminous emission; and a coaxial electric field applicator comprising:

an outer conductor assembly comprising a tubular outer conductor having a distal end disposed at or near a first end of said lamp capsule, an outer ring disposed at or near a second end of said lamp capsule, and a plurality of cage wires connected between said outer ring and said tubular outer conductor; and a center conductor assembly comprising a center conductor coaxially positioned with respect to said tubular outer conductor and having a distal end disposed at or near the first end of said lamp capsule, wherein said coaxial electric field applicator is mounted in said reflector and is connected to said high frequency power source, wherein high frequency power is coupled by said coaxial electric field applicator from said high frequency power source to said lamp capsule.

34. An electrodeless light source as defined in claim 33 wherein said cage wires extend between said outer ring and said tubular outer conductor inside said reflector.

35. An electrodeless light source as defined in claim 33 wherein said cage wires extend between said outer ring and said tubular outer conductor outside said reflector.

36. An electrodeless lamp assembly comprising:

an electrodeless, high intensity discharge lamp capsule; and a coaxial electric field applicator comprising an outer conductor having a distal end disposed at or near said lamp capsule and a center conductor assembly comprising a center conductor coaxially positioned with respect to said outer conductor and having a distal end disposed at or near said lamp capsule, and a guard ring structure coupled to said center conductor and disposed near said lamp capsule for concentrating electric fields generated by said electric field applicator in said lamp capsule, wherein high frequency power, supplied to said outer conductor and said center conductor, is coupled by said electric field applicator to said lamp capsule.

37. An electrodeless lamp assembly as defined in claim 36 wherein said guard ring structure includes a guard ring having a larger diameter than said center conductor.

38. An electrodeless lamp assembly as defined in claim 36 wherein said guard ring structure comprises a first guard ring having a first diameter and a second guard ring having a second diameter.

39. An electrodeless lamp assembly comprising:

an electrodeless, high intensity discharge lamp capsule comprising a light-transmissive discharge envelope enclosing a discharge volume containing a mixture of starting gas and chemical dopant material excitable by high frequency power to a state of luminous emission; and a coaxial electric field applicator comprising:

an outer conductor assembly comprising a tubular outer conductor having a distal end disposed at or near a first end of said lamp capsule, an outer ring disposed at or near a second end of said lamp capsule, and a plurality of cage wires connected between said outer ring and said tubular outer conductor; and a center conductor assembly comprising a center conductor coaxially positioned with respect to said tubular outer conductor and having a distal end disposed at or near the first end of said lamp capsule, said center conductor assembly further comprising a guard ring coupled to said center conductor and disposed near the first end of said lamp capsule for concentrating electric fields generated by said electric field applicator in said lamp capsule, wherein high frequency power, supplied to said tubular outer conductor and said center conductor, is coupled by said electric field applicator to said lamp capsule.

40. An electrodeless lamp assembly as defined in claim 39 wherein said guard ring has a larger diameter than said center conductor and is mechanically supported from said center conductor by a conductive structure.

* * * * *